US011094286B2

(12) United States Patent
Yokota et al.

(10) Patent No.: US 11,094,286 B2
(45) Date of Patent: Aug. 17, 2021

(54) IMAGE PROCESSING APPARATUS AND IMAGE PROCESSING METHOD

(71) Applicant: Sony Interactive Entertainment Inc., Tokyo (JP)

(72) Inventors: Kenichiro Yokota, Tokyo (JP); Hiroshi Mikami, Tokyo (JP)

(73) Assignee: SONY INTERACTIVE ENTERTAINMENT INC., Tokyo (JP)

( * ) Notice: Subject to any disclaimer, the term of this patent is extended or adjusted under 35 U.S.C. 154(b) by 20 days.

(21) Appl. No.: 16/185,352

(22) Filed: Nov. 9, 2018

(65) Prior Publication Data

US 2019/0172416 A1 Jun. 6, 2019

(30) Foreign Application Priority Data

Dec. 5, 2017 (JP) ..... JP2017-233773

(51) Int. Cl.
*G09G 5/02* (2006.01)
*G09G 5/391* (2006.01)
(Continued)

(52) U.S. Cl.
CPC ..... *G09G 5/026* (2013.01); *G09G 5/06* (2013.01); *G09G 5/391* (2013.01); *G09G 5/003* (2013.01); *G09G 5/397* (2013.01); *G09G 2320/0242* (2013.01); *G09G 2320/0673* (2013.01); *G09G 2340/0428* (2013.01);
(Continued)

(58) Field of Classification Search
CPC ... G09G 2320/0233; G09G 2320/0238; G09G 2320/0242; G09G 5/026; G09G 2340/125; G06T 5/007; G06T 2207/20208; H04N 13/172; H04N 13/178; H04N 2201/32; H04N 2201/3228; H04N 2201/3256
See application file for complete search history.

(56) References Cited

U.S. PATENT DOCUMENTS 9,501,855 B2 * 11/2016 Aiba ..... G06T 5/009
9,591,257 B2 3/2017 Oh et al.
(Continued)

FOREIGN PATENT DOCUMENTS

JP 2014-531821 A 11/2014
JP 2016-058848 A 4/2016
(Continued)

OTHER PUBLICATIONS

Japanese Office Action dated Nov. 5, 2019 for the Corresponding Japanese Patent Application No. 2017-233773.
(Continued)

*Primary Examiner* — Antonio A Caschera
(74) *Attorney, Agent, or Firm* — Katten Muchin Rosenman LLP

(57) ABSTRACT

An image processing apparatus for generating data of an image and outputting the generated data to a display device, includes a meta data acquiring unit configured to acquire meta data used for a correcting process for correcting the image in the display device, a corrector configured to perform at least part of the correcting process on the image, using the meta data, and an image output unit configured to acquire data of the corrected image from the corrector and output the acquired data to the display device.

7 Claims, 7 Drawing Sheets

(51) Int. Cl.

| | |
|---|---|
| ***G09G 5/06*** | (2006.01) |
| *G09G 5/397* | (2006.01) |
| *G09G 5/00* | (2006.01) |

(52) U.S. Cl.
CPC ... *G09G 2340/125* (2013.01); *G09G 2360/02* (2013.01); *G09G 2360/08* (2013.01); *G09G 2360/18* (2013.01)

(56) References Cited

U.S. PATENT DOCUMENTS

| | | | | |
|---|---|---|---|---|
| 10,679,585 | B2 * | 6/2020 | Oh | G06T 5/009 |
| 2016/0330513 | A1 * | 11/2016 | Toma | H04N 9/8205 |
| 2016/0358346 | A1 | 12/2016 | Hendry et al. | |
| 2017/0061591 | A1 * | 3/2017 | Park | G09G 3/2092 |

FOREIGN PATENT DOCUMENTS

| | | | |
|---|---|---|---|
| JP | 2016-538745 | A | 12/2016 |
| JP | 2017-092920 | A | 5/2017 |
| JP | 2017-123618 | A | 7/2017 |
| JP | 2017-167402 | A | 9/2017 |
| JP | 2017-200186 | A | 11/2017 |
| WO | 2013/046095 | A1 | 4/2013 |
| WO | 2017/051612 | A1 | 3/2017 |

OTHER PUBLICATIONS

Japanese Office Action dated Jun. 30, 2020, for the Corresponding Japanese Patent Application No. 2017-233773.

* cited by examiner

IMAGE PROCESSING APPARATUS AND IMAGE PROCESSING METHOD

BACKGROUND

The present disclosure relates to an image processing apparatus for displaying an image on a display device and an image processing method that is carried out by the image processing apparatus.

Heretofore, there have been developed various technologies for improving image quality of displayed video images of television broadcasts and moving image distribution services. In recent years, technologies for processing signals in HDR (High Dynamic Range) as an increased luminance range have been finding widespread use in addition to technologies for increasing resolution and color gamut. Since HDR provides an allowable luminance range that is approximately 100 times larger than SDR (Standard Dynamic Range), it enables objects that make viewers feel dazzled in the real world, e.g., sunlight reflections, to be rendered realistically in images. Images rendered in HDR give much presence in the virtual world not only for images of television broadcasts and moving image distribution services, but also for computer graphics images such as game images (see Japanese Patent Laid-open No. 2016-58848).

SUMMARY

SDR and HDR use different signal standards and different conversion processes in display devices. Therefore, if the user uses a display device capable of processing the luminance ranges of both SDR and HDR videos, a switching process needs to be performed in the display device depending on the preset luminance range of contents to be displayed on the display device. However, the switching process may cause the user to lose interest or to feel uneasy providing the switching process appears on the display screen. In addition, the user may have demands on viewing SDR contents unchanged on an HDR-compatible display device.

The present disclosure has been made under the circumstances. It is desirable to provide a technology capable of displaying images stably in appropriate states regardless of the preset luminance ranges of contents to be displayed.

According to an embodiment of the present disclosure, there is provided an image processing apparatus for generating data of an image and outputting the generated data to a display device, including: a meta data acquiring unit configured to acquire meta data used for a correcting process for correcting the image in the display device, a corrector configured to perform at least part of the correcting process on the image, using the meta data, and an image output unit configured to acquire data of the corrected image from the corrector and output the acquired data to the display device.

According to another embodiment of the present disclosure, there is provided an image processing method to be carried out by an image processing apparatus that generates data of an image and outputs the generated data to a display device, including: acquiring meta data used for a correcting process for correcting the image in the display device, performing at least part of the correcting process on the image, using the meta data, and acquiring data of the corrected image and outputting the acquired data to the display device.

Any combinations of the above components and expressions of the present disclosure, as they are converted between a method, an apparatus, a system, a computer program, and a recording medium storing a computer program therein are also effective as embodiments of the present disclosure.

According to the present disclosure, images in appropriate states can stably be displayed regardless of preset luminance ranges of contents.

DETAILED DESCRIPTION OF THE PREFERRED EMBODIMENT

Figure 1:
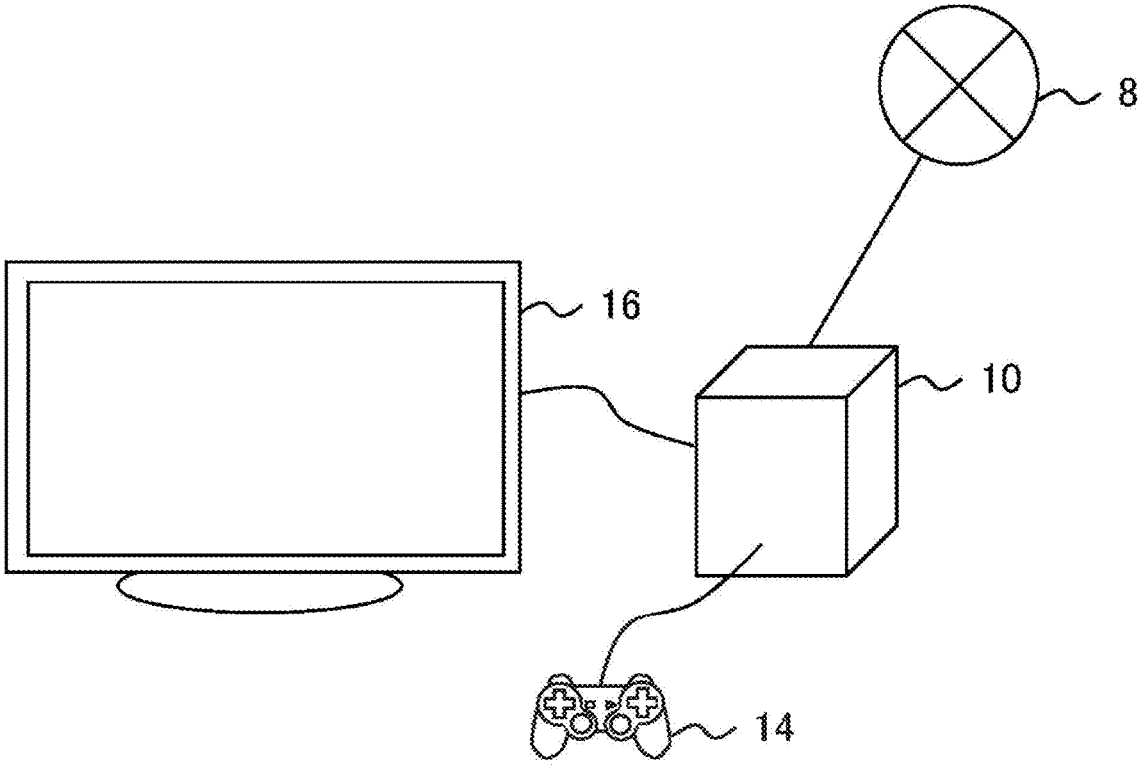
FIG. 1 is a view illustrating a configurational example of an image processing system according to an embodiment of the present disclosure.

FIG. 1 illustrates a configurational example of an image processing system according to an embodiment of the present disclosure. As depicted in FIG. 1, the image processing system includes an image processing apparatus 10, an input device 14, and a display device 16. The image processing apparatus 10 may be connected to a server or the like that provides various contents through a network 8 such as the Internet. The input device 14 may be a general input device operable by the user, such as a controller, a keyboard, a mouse, a joystick, a touch pad, or the like, or an image capturing device operable by the user to capture images of the real world, a microphone for acquiring sounds, a sensor for detecting any of various physical values, or a combination of any of these input devices.

The display device 16 includes a liquid crystal display, a plasma display, or an organic EL (Electroluminescence) display for displaying images. The display device 16 may include speakers for outputting sounds. The input device 14 and the display device 16 may be connected to the image processing apparatus 10 through a wired link such as a cable or through a wireless link such as a wireless LAN (Local Area Network). The input device 14, the display device 16, and the image processing apparatus 10 are not limited to the illustrated appearances, but may be implemented in various configurations. For example, two or more of them may be integrally combined with each other.

The image processing apparatus 10 receives a signal based on a user's action from the input device 14, carries out a processing sequence depending on the received signal to generate data of a display image, and outputs the generated data to the display device 16. The image processing apparatus 10 may be implemented as any one of a game machine, a contents reproducing apparatus, a personal computer, a tablet terminal, a portable terminal, and a mobile phone. The processing sequence carried out by the image processing apparatus 10 may have any of various contents depending on its implemented form or an application that the user has selected thereon. For example, the image processing apparatus 10 makes an electronic game specified by the user progress depending on a user's action, and generates and outputs data of a game screen at a predetermined frame rate.

Alternatively, the image processing apparatus 10 may acquire a data stream of moving images distributed from an OTT (Over-The-Top) contents provider via the network 8 or a program broadcast for television, or read moving-image data recorded on a recording medium such as a DVD (Digital Versatile Disc) or a Blu-ray Disc, and decode and output the data sequentially. The image processing apparatus 10 may thus be used for various purposes, and may carry out information processing sequences with different contents depending on the various purposes. Rendering images such as game screens instantaneously and decoding data of contents such as encoded moving images will hereinafter be referred to as "generating" images, and processing of generated images will mainly be described below.

Figure 2:
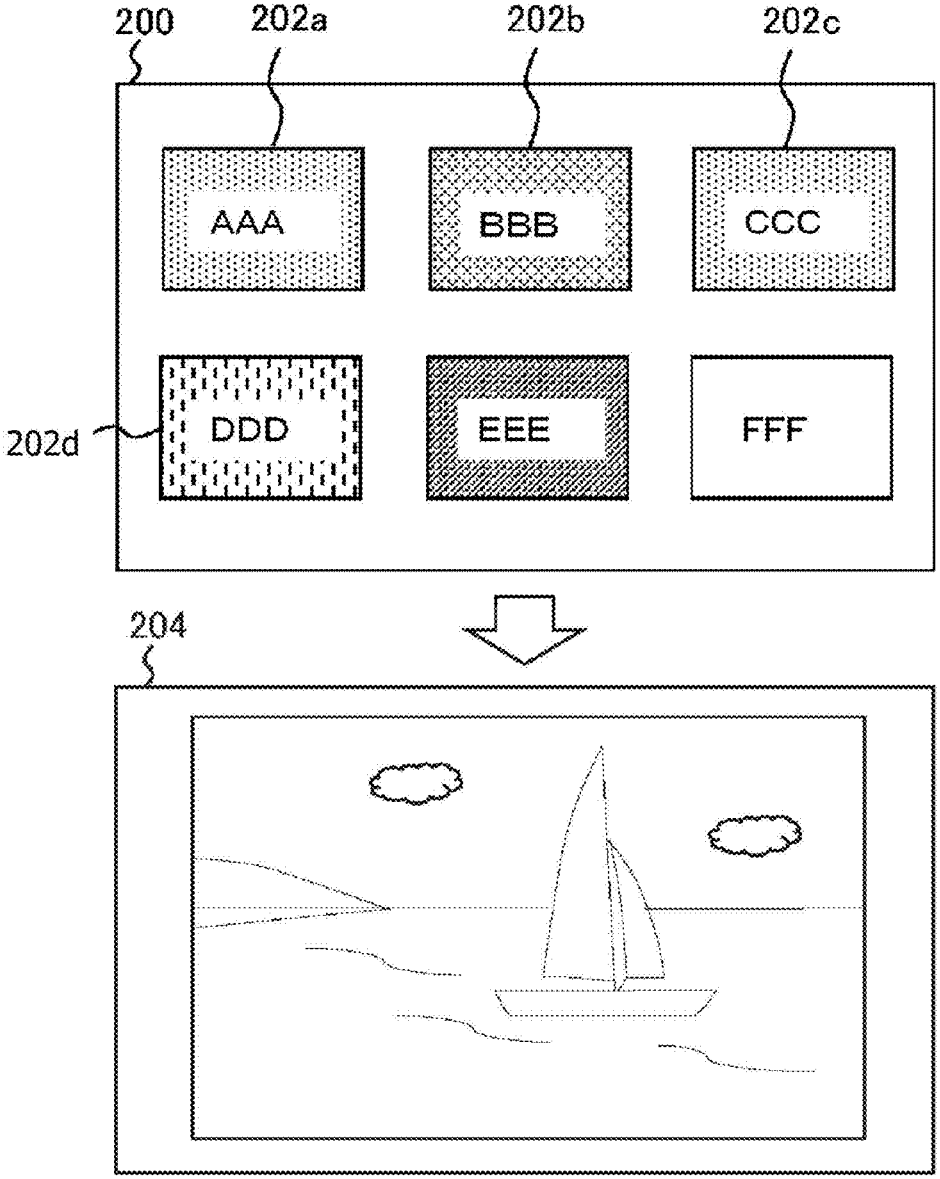
FIG. 2 is a schematic diagram illustrating by way of example an image generated by an image processing apparatus according to the embodiment.

FIG. 2 schematically illustrates by way of example an image generated by the image processing apparatus 10 according to the present embodiment. It is assumed in the illustrated example that one of a plurality of moving images is selected and reproduced. FIG. 2 depicts in its upper area a selection screen 200 for selecting moving images, in which title images, e.g., title images 202*a*, 202*b*, 202*c*, and 202*d*, of the moving images are depicted as options. When the user selects either one of them, a reproduced screen 204 of the selected moving image is displayed.

Specifically, when the user enters a signal for specifying one of the title images through the input device 14, the image processing apparatus 10 acquires data of the specified moving image from a recording medium or a network, decodes the data, and outputs the decoded data to the display device 16. The moving images of selectable candidates indicated on the selection screen 200 include those expressed in a luminance space of SDR and those expressed in a luminance space of HDR, mixed together.

Figure 3A:
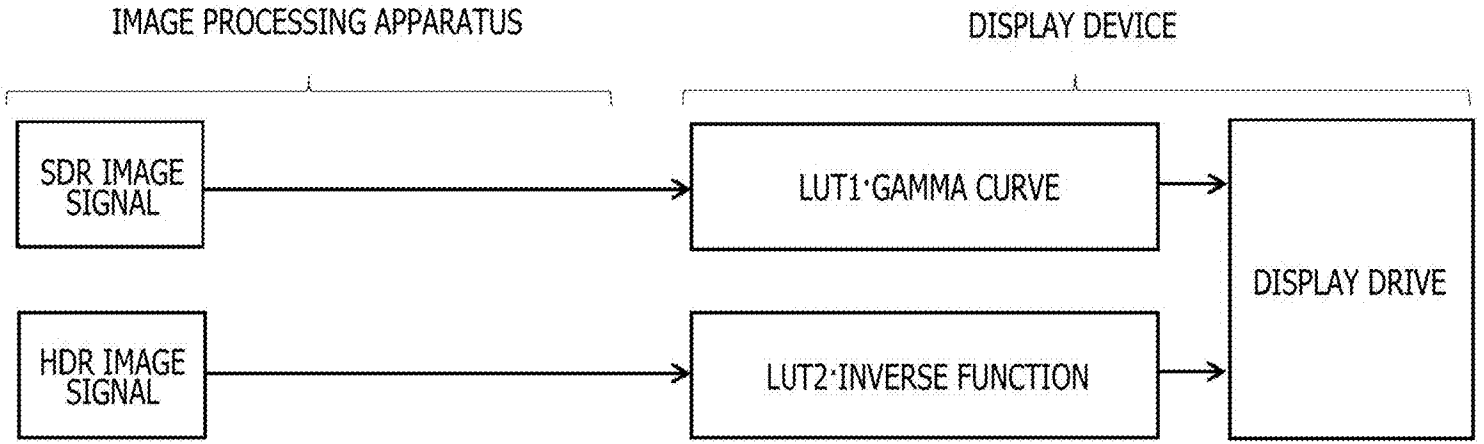
FIGS. 3A and 3B are diagrams each illustrating an example of processing courses up to the display of images in different luminance spaces according to the embodiment.
Figure 3B:
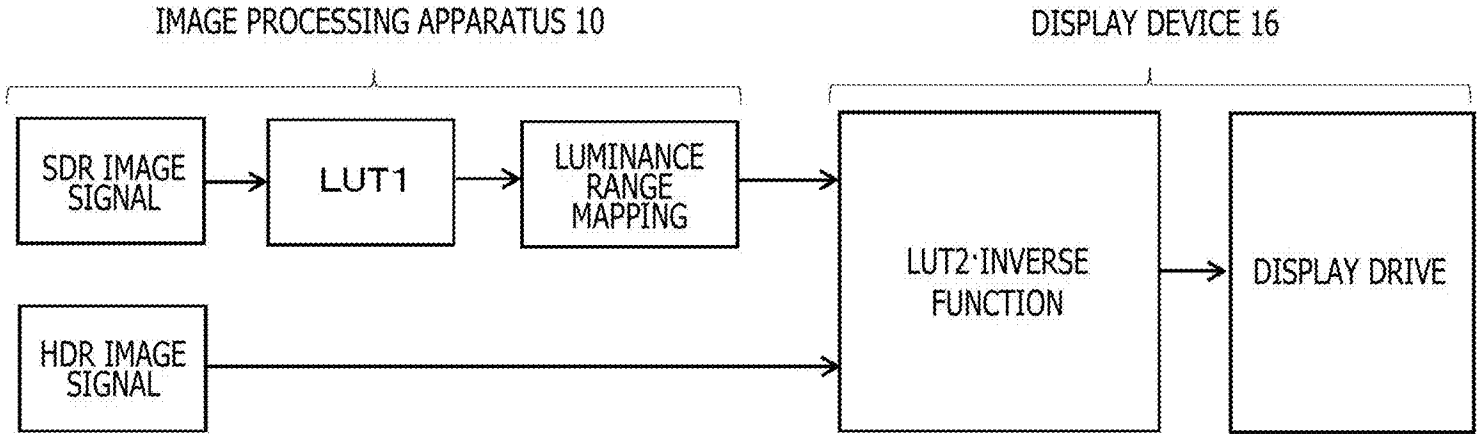

FIGS. 3A and 3B schematically illustrate an example of processing courses up to the display of images in different luminance spaces according to the embodiment. In this example, the display device is compatible with both SDR and HDR. Generally, SDR images are processed according to independent standards BT.709 and BT.2020, and HDR images are processed according to independent standards BT.2100. SDR and HDR videos have different ranges of luminance represented by their original images and also have different transfer functions for converting bit depths, color gamuts, and luminance values of electric signals into electric signals. Heretofore, therefore, different signals of SDR and HDR moving images are sent from the image processing apparatus to the display device, as depicted in FIG. 3A.

The display device carries out a color correction on an SDR signal, for example, using a lookup table "LUT1" available for SDR, acquires luminance values of respective colors for each pixel according to the gamma curve inherent with its display unit, and drives the display unit with drive voltages based on the acquired luminance values. On the other hand, the display device carries out a color correction on an HDR signal, using a lookup table "LUT2" available for HDR, acquires luminance values of respective colors for each pixel according to a function that is the inverse of the function used to generate the HDR image signal, and drives the display unit with drive voltages based on the acquired luminance values.

SDR images can be expressed in a luminance range from 0 to 100 nits and HDR images can be expressed in a luminance range from 0 to 1000 nits even though they are represented by 10-bit signals. The process of converting electric signals to luminance values and the color correction process may be carried out in various orders, as can be understood by those skilled in the art. In any case, according to the related art, the display device needs to change processing systems each time it receives electric signals according to different standards.

Specifically, in a situation where contents represented by SDR and contents represented by HDR are mixed together, a switching process is required to call a lookup table again depending on which contents are selected. As a result, even if the user expects certain effects for seamlessly changing from the selection screen 200 to the reproduced screen 204 of the moving image selected by the user, as depicted in FIG. 2, the display device may cause temporary blackout where nothing is displayed or may take some time after the user has selected the moving image until the selected moving image is reproduced. In case the user specifies moving images one after another for zapping, the waiting time may make the user feel highly stressful.

The image processing apparatus 10 according to the present embodiment outputs an SDR electric signal as an HDR electric signal to the display device 16 by mapping the luminance range of an SDR image onto the luminance range of an HDR image. Since the display device 16 may now perform only processing sequences based on the HRD standards, it requires no process of switching between the luminance ranges. For example, if the luminance of SDR and the luminance of SDR are represented by 10 bits, the maximum luminance of SDR can be compressed to R times the luminance of SDR by multiplying the gradations of the luminance of SDR by a predetermined compression ratio R ($0<R<1.0$) of 0.5, for example.

However, such a simple luminance range mapping process give rise to the following problems: Devices for displaying SDR contents are designed to display higher-definition images by applying special techniques to a process of converting the luminance of original images represented by electric signals to the luminance of images for display, as a result of various technological renovations that have been achieved in a long history. For example, the number of gradations of an input signal is converted to a higher number of gradations for extracting good display colors.

One form for deriving signals representing display colors directly from input signals based on such complex calculations is a lookup table denoted by "LUT1," for example, in FIGS. 3A and 3B. Lookup tables include a one-dimensional lookup table where values to be converted and converted values are associated with RGB (Red, Green, and Blue) values and a three-dimensional lookup table where a set of converted RGB values is associated with a set of RGB values to be converted. The data to be converted and the converted data may be electric signals or luminance values.

The lookup table "LUT1" is unique to the manufacturer and type of the display device 16 because of the history of the SDR contents display devices referred to above. A color correction is also performed on HDR signals. However, since HDR images can be displayed in a variety of expressions on their own, a lookup table "LUT2" for HDR signals is often different from the lookup table "LUT1" evolved for SDR. Consequently, if the different lookup table "LUT2" is used for the simple luminance range mapping process, then resultant images may make poorer impressions on the viewer than the results of an existing color correction on SDR signals.

According to the present embodiment, as depicted in FIG. 3B, the image processing apparatus 10 carries out the color correction process that the display device 16 has performed on SDR signals, and also maps the luminance range of SDR signals onto the luminance range of HDR signals. For example, the image processing apparatus 10 acquires the data of the lookup table "LUT1" installed in the display device 16 and performs a color correction based thereon. Inasmuch as the display device 16 may now perform only HDR signal processing sequences regardless of whether the original moving image is in SDR or HDR, it does not suffer a delay that would otherwise occur due to the switching process, and is capable of displaying images equivalent to those obtained from SDR signals.

The data acquired by the image processing apparatus 10 are not limited to the lookup table for color correction. If the display device 16 does not have a lookup table and converts pixel values according to a function, then the image processing apparatus 10 may acquire the function from the display device 16. Furthermore, the image processing apparatus 10 may acquire at least either one of the compression ratio R at which the display device 16 compresses SDR gradations to HDR gradations, positional coordinates of primary colors such as RGB and neutral point in an xy chromaticity diagram, the maximum luminance or an average luminance value that the display device 16 can display, and the maximum luminance at the time black is rendered. In other words, the image processing apparatus 10 may acquire any of the data used for correcting or converting SDR signals or luminance values produced by converting SDR signals. Such data will hereinafter be referred to as "color control meta data."

Figure 4:
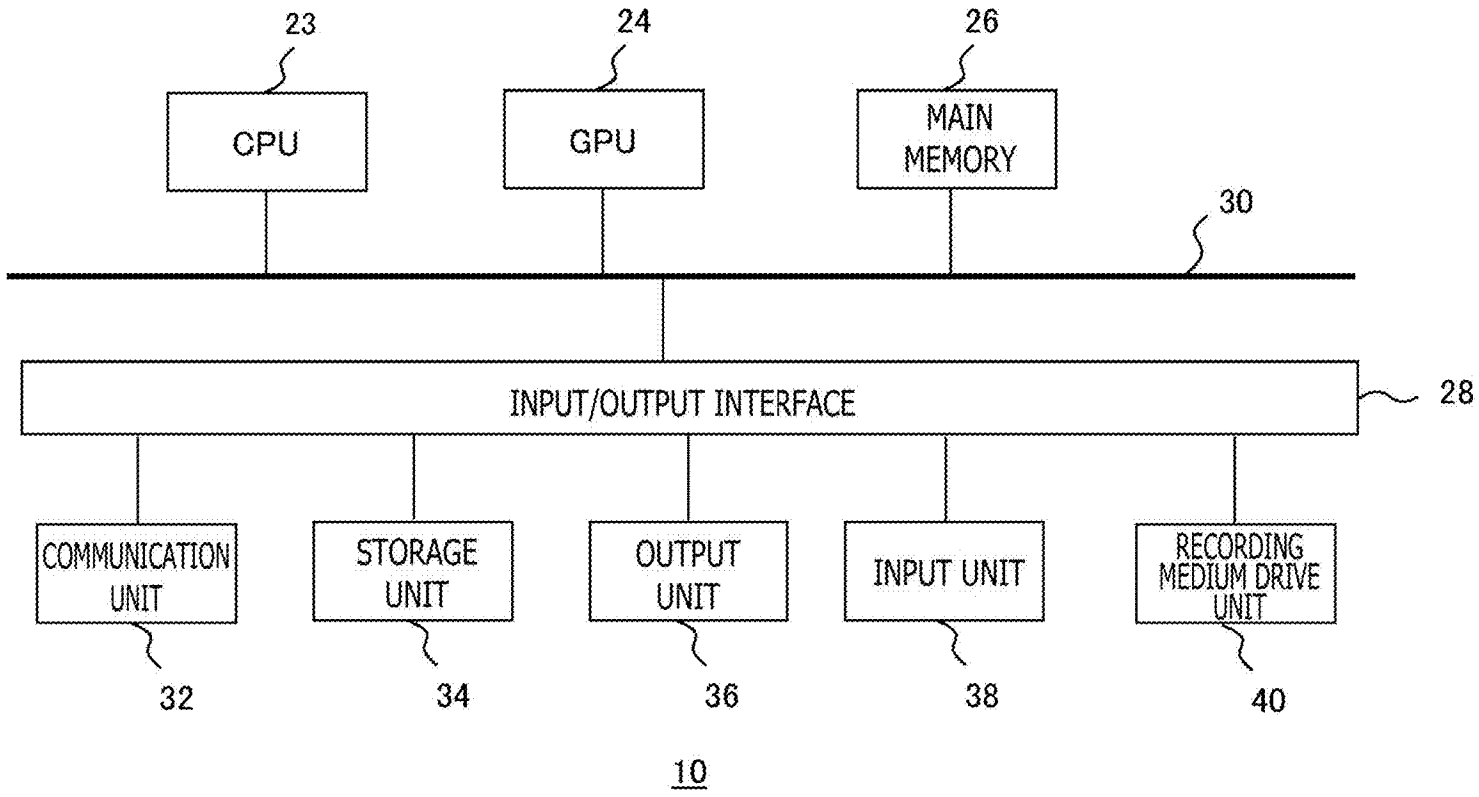
FIG. 4 is a block diagram illustrating an internal circuit arrangement of the image processing apparatus according to the embodiment.

FIG. 4 illustrates an internal circuit arrangement of the image processing apparatus 10 according to the embodiment. As depicted in FIG. 4, the image processing apparatus 10 includes a CPU (Central Processing Unit) 23, a GPU (Graphics Processing Unit) 24, and a main memory 26. The CPU 23, the GPU 24, and the memory 26 are connected to each other by a bus 30. To the bus 30, there is connected an input/output interface 28 that is connected to a communication unit 32 such as an peripheral device interface such as USB (Universal Serial Bus) or IEEE (Institute of Electrical and Electronics Engineers) 1394 or a wired or wireless LAN network interface for connection to the network 8, a storage unit 34 such as a hard disk drive or a nonvolatile memory, an output unit 36 for outputting data to the display device 16, an input unit 38 for inputting data from the input device 14, and a recording medium drive unit 40 for driving a removable recording medium such as a magnetic disk, an optical dis, or a semiconductor memory.

The CPU 23 controls the image processing apparatus 10 in its entirety by executing an operating system stored in the storage unit 34. The CPU 23 also executes various programs read from the removable recording medium and loaded into the main memory 26 or downloaded via the communication unit 32. The communication unit 32 may also establish a communication link with an external apparatus such as a server via the network 8, acquire data of electronic contents such as moving images, and send data generated in the image processing apparatus 10.

The GPU 24 has a function as a geometry engine and a function as a rendering processor, performs a rendering process according to a rendering command from the CPU 23, and stores data of a display image into a frame buffer, not depicted. The GPU 24 converts a display image stored in the frame buffer into a video signal and outputs the video signal through the output unit 36 for the display device 16 to display an image. The main memory 26 includes a RAM (Random Access memory) and stores data and programs necessary for processing sequences.

Figure 5:
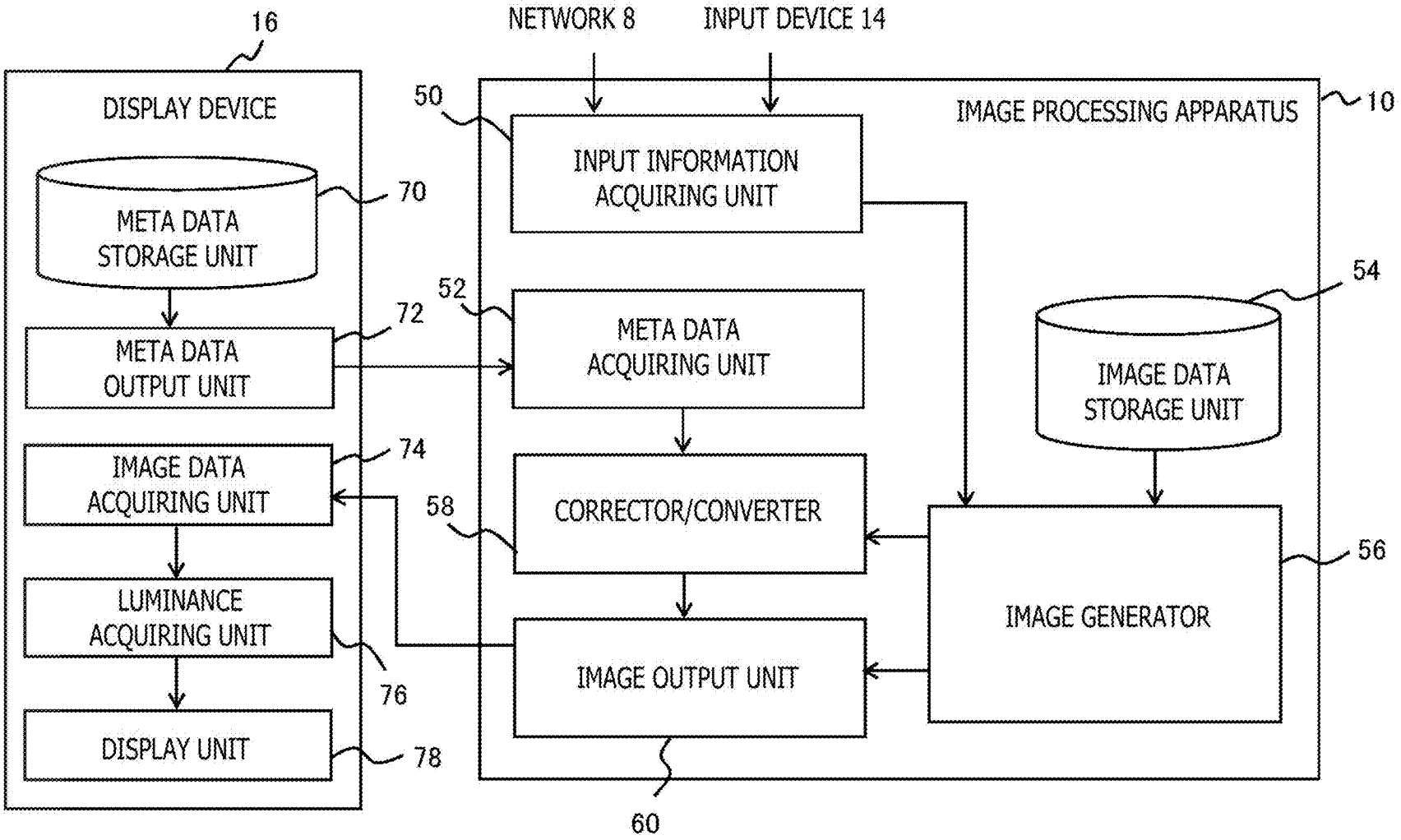
FIG. 5 is a block diagram illustrating functional blocks of the image processing apparatus and a display device according to the embodiment.

FIG. 5 illustrates functional blocks of the image processing apparatus 10 and the display device 16 according to the embodiment. The functional blocks depicted in FIG. 5 may be hardware-implemented by the CPU, the GPU, the various memories, and the data bus depicted in FIG. 4 or may be software-implemented by programs loaded from the recording medium into the storage unit and performing various functions including a data inputting function, a data holding function, a calculating function, an image processing function, and a communicating function. That these functional blocks can be performed by hardware only, software only, and a combination of hardware and software can be understood by those skilled in the art, and the functional blocks should not be limited to either hardware or software.

The image processing apparatus 10 includes an input information acquiring unit 50 for acquiring input information from the input device 14, a meta data acquiring unit 52 for acquiring color control meta data from the display device 16, an image generator 56 for generating image data, an image data storage unit 54 for storing data used to generate images, a corrector/converter 58 for performing a color correction on and mapping a luminance range onto SDR images, and an image output unit 60 for outputting image data to the display device 16.

The input information acquiring unit 50 is realized by the input unit 38, the communication unit 32, and the CPU 23, and acquires data representing contents of user's actions from the input device 14. User's actions may be actions performed for general contents processing sequences, such as actions to select an application to be executed and contents to be output, actions to start and finish processing sequences, and actions to input commands for applications. If an image capturing device or any of various sensors is used as the input device 14, then the input information acquiring unit 50 may acquire captured images from the image capturing device or data such as output values from the sensors.

The input information acquiring unit 50 may also acquire data of electronic contents such as moving images from a server via the network 8. The input information acquiring unit 50 supplies the acquired data to the image generator 56. The meta data acquiring unit 52 is realized by the input unit 38, the communication unit 32, and the CPU 23, and acquires color control meta data from the display device 16 at predetermined timings such as when the display device 16 is connected for the first time. However, the timings at which the color control meta data are acquired and the source of the color control meta data are not limited to those described above. The meta data acquiring unit 52 may ask a server, not depicted, having a database where display device types and color control meta data are associated with each other, to acquire color control meta data corresponding to the display device 16 that is connected.

The database described above may be held in the display device 16 or the meta data acquiring unit 52 itself. The meta data acquiring unit 52 may not acquire all meta data used for a correction or a converting process carried out on SDR images inside the display device 16 that is connected. For example, the meta data acquiring unit 52 may store general meta data common to display devices, and the image processing apparatus 10 may perform a color correction by combining the stored general meta data with some of the meta data acquired from the display device 16 that is connected. In cases, the image processing apparatus 10 may perform a color correction using only the general meta data.

The image generator 56 is realized by the CPU 23, the GPU 24, and the main memory 26, and generates data of display images according to information representing user's actions acquired from the input information acquiring unit 50. For example, when the user selects a game, the image generator 56 renders a game image depending on user's actions and sensor output values at a predetermined frame rate. At this time, the image generator 56 reads programs for making the game progress and data of object models for rendering the image from the image data storage unit 54.

Alternatively, the image generator 56 may decode and expand data of moving images and still images specified by the user. The data of the images may be stored in the image data storage unit 54 and read therefrom, or may be distributed from a server via the network 8. Further alternatively, the image generator 56 may acquire, decode, and expand data of images captured by an image capturing device included in the input device 14.

The corrector/converter 58 is realized by the CPU 23, the GPU 24, and the main memory 26, and converts data expressed in the SDR luminance range, among the image data generated by the image generator 56, into data in the HDR luminance range. At this time, the corrector/converter 58 uses the color control meta data acquired by the meta data acquiring unit 52 and performs processing sequences on the data which are equivalent to the color correction that is performed on SDR signals in the display device 16.

The corrector/converter 58 performs the color correction by converting a set of RGB luminance values for each pixel using the lookup table, for example, and quantizes the converted luminance values into gradations of an HDR electric signal. Alternatively, the corrector/converter 58 performs the color correction on quantized SDR data using the lookup table and thereafter further converts the data into gradations in the HDR luminance range. The compression ratio R for assigning gradations in the SDR luminance space to gradations in the HDR luminance space may be of a value that the meta data acquiring unit 52 has acquired from the display device 16.

The maximum luminance that the display of the display device 16 can actually express and the maximum display for expressing black are inherent with the display device 16. Generally, display devices also perform a converting process for keeping the luminance values of an image that has been input within a range of luminance values that can actually be expressed. Therefore, the corrector/converter 58 may acquire the range of luminance values as color control meta data and perform an equivalent converting process. The details of the correcting and converting processes carried out by the corrector/converter 58 do not need to be strictly identical to, but may be partly equivalent to the correcting and converting processes actually carried out by the display device 16.

The processing sequences during operation may be speeded up by producing a lookup table that simultaneously realizes the color correction process performed by the display device 16 and the process of assigning SDR gradations to HDR gradations. Alternatively, the color correction process may be performed after the process of assigning SDR gradations to HDR gradations has been carried out. The image output unit 60 is realized by the CPU 23, the GPU 24, the main memory 26, and the output unit 36, and quantizes the image data generated by the image generator 56 according to the HDR standards and outputs the quantized image data to the display device 16. If the image data generated by the image generator 56 are SDR image data, then the image output unit 60 acquires data that have been color-corrected and mapped onto HDR luminance values from the corrector/converter 58 and outputs the acquired data.

If the corrector/converter 58 includes a function to convert signals into HDR electric signals, then the image output unit 60 may omit the processing sequences of the function. If the image generated by the image generator 56 is an HDR image on its own, the image output unit 60 acquires its data directly from the image generator 56, converts the data into an HDR electric signal, and outputs the HDR electric signal. Alternatively, the image output unit 60 may combine an image that the corrector/converter 58 has converted from the SDR luminance range to the HDR luminance range and an HDR image directly acquired from the image generator 56, and output the combined images. In any case, the image output unit 60 outputs signals according to the HDR standards to the display device 16.

The display device 16 includes a meta data storage unit 70 for storing color control meta data, a meta data output unit 72 for outputting meta data to the image processing unit 10, an image data acquiring unit 74 for acquiring image data from the image processing apparatus 10, a luminance acquiring unit 76 for converting image data into luminance values to be displayed, and a display unit 78 for driving the display to display an image.

When the display device 16 receives a signal of an SDR image, the meta data storage unit 70 stores color control meta data used for a color correction to be performed on the image in the display device 16. In response to a request from the image processing apparatus 10, the meta data output unit 72 outputs the color control meta data read from the meta storage unit 70 to the image processing apparatus 10. The image data acquiring unit 74 acquires image data from the image processing apparatus 10. As described above, the acquired image data are represented by HDR signals independent of the luminance range of the original image. However, the display device 16 may have a system for acquiring SDR signals from the image processing apparatus 10, as is conventional.

The luminance acquiring unit 76 acquires a set of RGB luminance values for each pixel by dequantizing image data. Since the data input from the image processing apparatus 10 are uniformly represented by signals according to the HDR standards, calculations used for dequantization are also uniformized. The luminance acquiring unit 76 may carry out a color correction by using the lockup table as depicted in FIGS. 3A and 3B by performing a uniform process on HDR images. In other words, the luminance acquiring unit 76 may perform a correcting/converting process that general display devices carry out on HDR signals.

The luminance acquiring unit 76 may have a separate function for processing SDR signals by performing a color correction and acquiring luminance by reading color control meta data from the meta data storage unit 70. However, such a function is omitted from illustration as it is not indispensable in the present embodiment. The display unit 78 drives the display to display an image to express the colors of each pixel at luminance values acquired by the luminance acquiring unit 76. These functions allow the display device 16 to display an image in optimum color tones regardless of the luminance range of the original data without the need for switching processes in the display device 16.

Figure 6A:
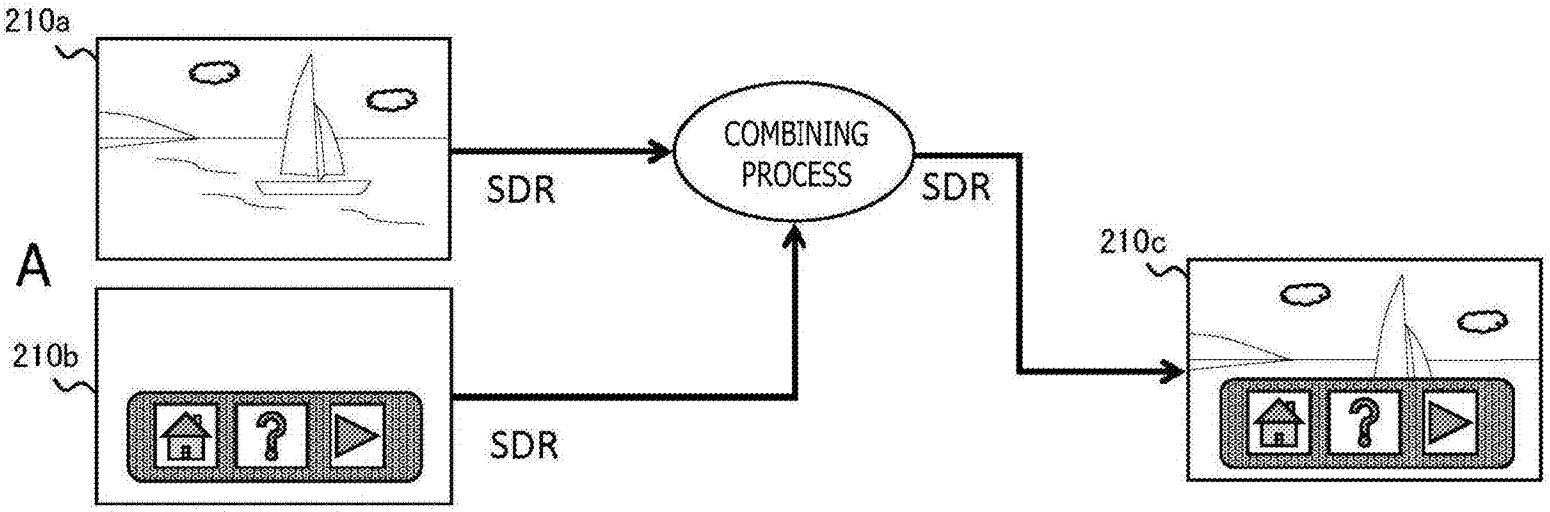
FIGS. 6A and 6B are diagrams each illustrating effects produced when a plurality of images are combined according to the embodiment.
Figure 6B:
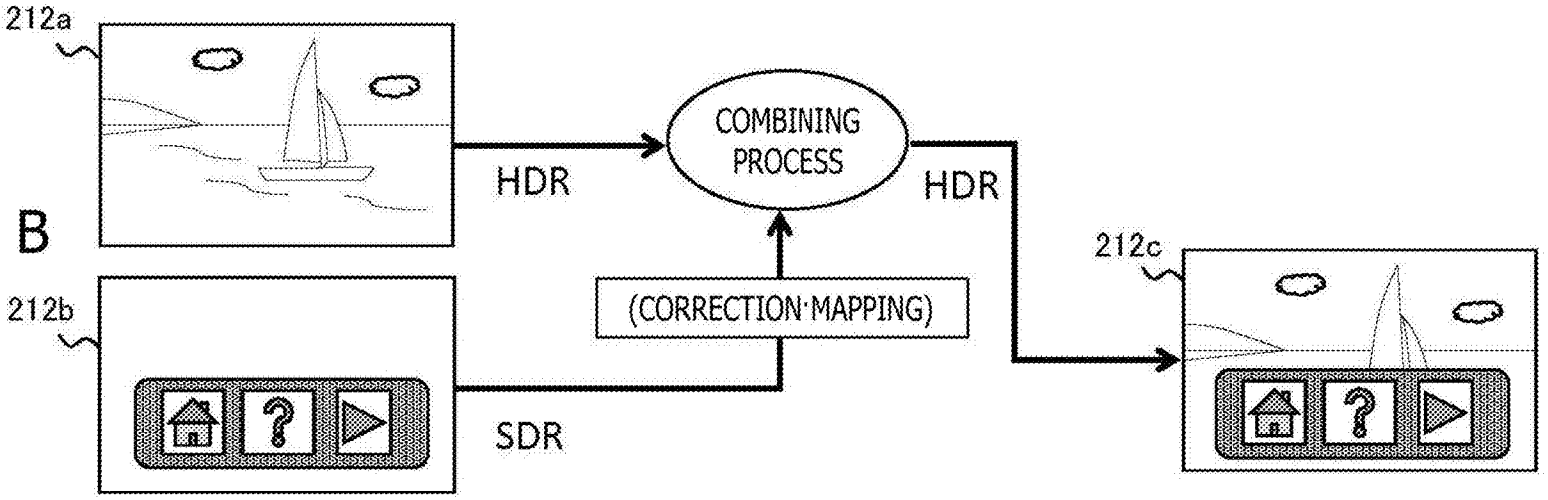

FIGS. 6A and 6B are diagrams each illustrating effects produced when a plurality of images are combined according to the embodiment. FIGS. 6A and 6B depict a mode for displaying images 210*b* and 212*b* of a GUI (Graphic User Interface) for the user to enter settings and actions for contents, in superposed relation to respective main images 210*a* and 212*a* representing contents themselves such as a game or a moving image. The main images 210*a* and 212*a* may include images expressed in the SDR luminance space and images expressed in the HDR luminance space, mixed together for reasons of the contents provider and different contents production timings.

When a GUI function provided by a game machine or a contents reproducing apparatus is called up, it is considered that the images 210*b* and 212*b* of GUI may be expressed uniformly in the SDR luminance space. As depicted in FIG. 6A, in case both the main image 210*a* and the GUI image 210*b* are images in the SDR luminance space, then they can be combined together by a simple process of adding the values of the pixels at a predetermined ratio, displaying a combined image 210*c*.

At this time, the display device 16 that has acquired the SDR signal performs a color correction process in a manner to maximize the performance of the display for displaying SDR images. As depicted in FIG. 6B, in case the main image 212*a* is an image in the HDR luminance space and the GUI image 212*b* is an image in the SDR luminance space, then the former image in the HDR luminance space is expressed in a large number of gradations on its own. If the GUI image 212*b* is converted into luminance values in the HDR luminance range by simply multiplying itself by the compression ratio R and the converted image is combined with the main image 212*a*, displaying a combined image 212*c*, then the GUI in the combined image 212*c* tends to be in poorer color shades than the GUI in the combined image 210*c* depicted in FIG. 6A.

Specifically, the color tones of an image such as of a GUI to be overlappingly displayed may be changed depending on the preset luminance range of the contents themselves. In the image processing apparatus 10 according to the present embodiment, as depicted in FIG. 6B, the corrector/converter 58 performs a color correction on an SDR image and a process of mapping the SDR luminance range of the SDR image onto the HDR luminance range of an HDR image, prior to an image combining process. In this manner, the GUI can stably be displayed on the HDR image in color tones that remain the same when the GUI is displayed on the SDR contents.

The present embodiment is also applicable to the process illustrated in FIG. 6A. Specifically, the corrector/converter 58 performs a color correction on the combined image 210*c* of SDR that has been generated by the combining process and then maps the luminance range of the combined image 210*c* of SDR onto the luminance range of an HDR image. Alternatively, the corrector/converter 58 performs a color correction on the images 210*a* and 210*b* before they are combined, then combines the images 210*a* and 210*b*, and thereafter maps the luminance range of the combined image 210*c* onto the luminance range of an HDR image. Since the signals acquired by the display device 16 as depicted in FIGS. 6A and 6B are uniformized in HDR, the display device 16 does not need any time for a switching process. In an environment where no instantaneous switching process is required, the system for outputting image data as SDR data as depicted in FIG. 6A and the system for outputting image data as HDR data depicted in FIG. 6B may be used in combination with each other.

Figure 7:
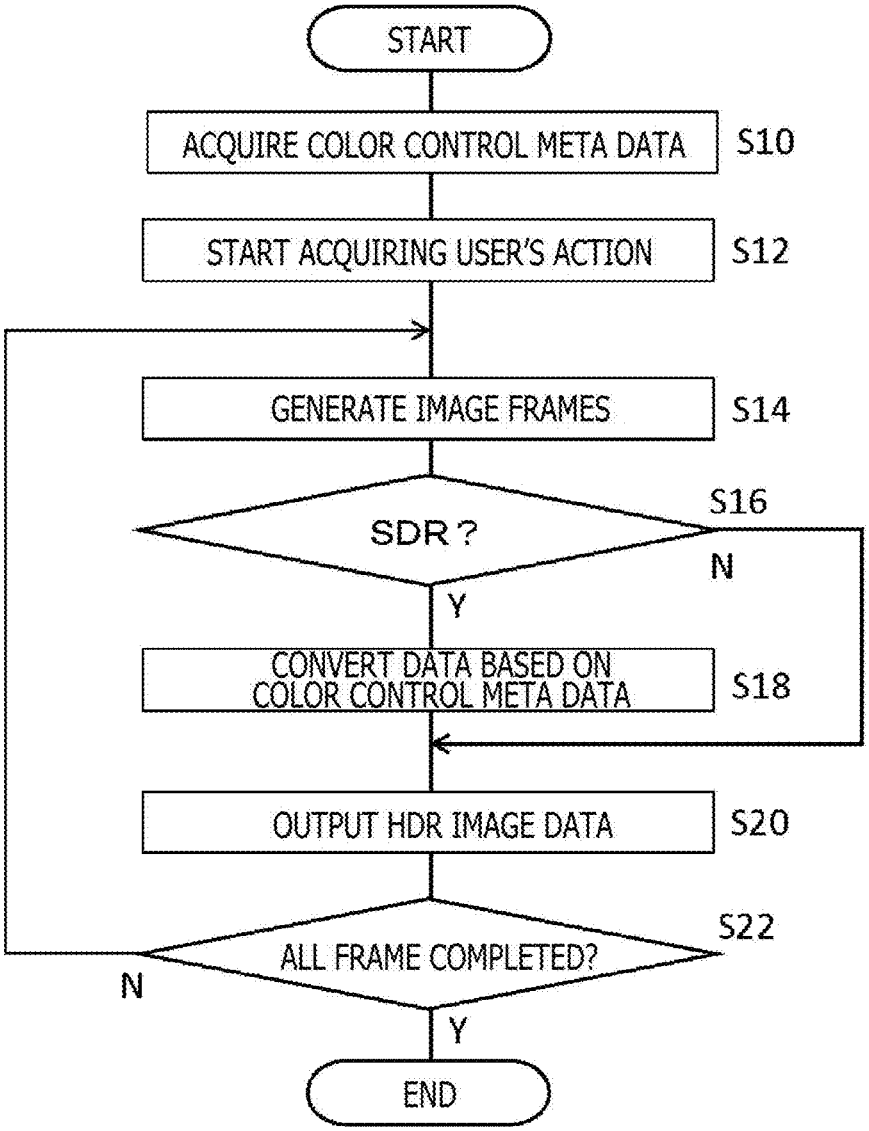
FIG. 7 is a flowchart of a processing sequence in which the image processing apparatus according to the embodiment generates image data and outputs the image data to the display device.

Operation of the image processing apparatus 10 thus arranged will be described below. FIG. 7 is a flowchart of a processing sequence in which the image processing apparatus 10 according to the embodiment generates image data and outputs the image data to the display device 16. First, the meta data acquiring unit 52 acquires color control meta data from the display device 16 that is connected to the image processing apparatus 10 in step S10. The meta data acquiring unit 52 carries out the acquiring step at any desired time prior to an image generating process. Then, the input information acquiring unit 50 starts acquiring information of a user's action such as to select contents in step S12.

Then, the image generator 56 appropriately processes the contents specified in step S12, and generates image frames by rendering or decoding image data in step S14. If the generated image is expressed in the SDR luminance range (Y in step S16), then the corrector/converter 58 corrects or converts the image data using the color control meta data acquired in step S10, generating image data in the HDR luminance space in step S18. The image output unit 60 outputs the HDR image data generated in step S18 or the image data generated by the image generator 56 and originally expressed in the HDR luminance space (N in step S16) to the display device 16 in step S20.

At this time, the image output unit 60 may convert luminance values into electric signals according to the HDR standards, or the corrector/converter 58 may carry out a color correction process and a quantizing process at the same time, and the image output unit 60 may output the processed data sequentially. For combining the images as depicted in FIGS. 6A and 6B, the image output unit 60 may combine the main image generated by the image generator 56 with the GUI image color-corrected and converted by the corrector/converter 58 and then output the combined image. If all the frames have not yet been output (N in step S22), the processing from steps S14 to S20 are repeated on a next image frame. The display device 16 then displays images according to a general process performed on HDR images. If all the frames to be displayed have been output (Y in step S22), the processing sequence is ended.

According to the present embodiment, as described above, the image processing apparatus for displaying generated images on the display device that is compatible with SDR and HDR maps an image expressed in the SDR luminance spaced onto image data in the HDR luminance space. The display device thus does not need to switch to a process depending on the luminance space of an input signal. For mapping the luminance space, the image processing apparatus carries out a color correction process inherent with the display device, which the display device performs on SDR image data. As a result, even if contents expressed in different luminance spaces are mixed together, the contents can seamlessly be switched one from the other without adversely affecting the image quality thereof.

Because of the function to perform a color correction on SDR images and convert the SDR images into image data in the HDR luminance space, a common processing system can be used to combine images easily together both for displaying SDR images alone and for displaying an SDR image in superposed relation to an HDR image. As the image processing apparatus guarantees the color tones of images expressed in SDR, the images can be displayed in stable color tones irrespective of the combination of preset luminance spaces of images to be combined.

The present disclosure has been described above based on the illustrated embodiment. However, the embodiment is illustrated by way of example only, and the various components and processes that are illustrated may be changed and modified in various ways and combinations, as can be understood by those skilled in the art.

For example, in the above embodiment, it is assumed that the image processing apparatus converts SDR images into HDR images. However, luminance ranges of image data that are to be converted and that have been converted are not limited to any particular luminance ranges. Furthermore, the image processing apparatus may perform other processes than the conversion of luminance ranges. Specifically, the image processing apparatus may perform a color correction process that the display device is supposed to carry out, using color control meta data, and then may process or convert the image data. The image processing apparatus thus arranged is able to process or convert the image data freely without adversely affecting the color tones of images that are displayed as a result. Therefore, the present disclosure is not limited to any combination of luminance ranges of images to be processed and any combination of luminance ranges that the display device is compatible with.

The present disclosure contains subject matter related to that disclosed in Japanese Priority Patent Application JP 2017-233773 filed in the Japan Patent Office on Dec. 5, 2017, the entire content of which is hereby incorporated by reference.

What is claimed is:

1. An image processing apparatus for generating data of an image and outputting the generated data to a display device, comprising:

a metadata acquiring unit configured to acquire color control metadata from a plurality of color control metadata, wherein the acquired color control metadata is used for converting the image from a standard dynamic range (SDR) image—to a high dynamic range (HDR) image, wherein the display device is externally connected to the image processing apparatus, wherein the display device is a physically separate device from the display device, and wherein the acquired color control metadata is specific to the display device;

a corrector configured to perform at least part of the correcting process on the image, using the acquired color control metadata; and an image output unit configured to acquire data of the corrected image from the corrector and output the acquired data to the display device, wherein the corrected image is the HDR image.

2. The image processing apparatus according to claim 1, wherein the corrector additionally performs a predetermined process independent on the display device in combination with the correcting process, on the image.

3. The image processing apparatus according to claim 1, wherein the image output unit combines the image acquired from the corrector and another image into a combined image in the predetermined luminance space and outputs the combined image to the display device.

4. The image processing apparatus according to claim 1, wherein the metadata acquiring unit acquires, as the color control metadata, either one of conversion rules for the display device to convert pixel values, positional coordinates of primary colors in an xy chromaticity diagram, and positional coordinates of a neutral point in the xy chromaticity diagram.

5. The image processing apparatus according to claim 1, wherein the metadata acquiring unit acquires the color control metadata from a server connected thereto via a network.

6. An image processing method comprising:

acquiring color control metadata from a plurality of color control metadata using an image processing apparatus, wherein the color control metadata is specific to a display device;

converting a standard dynamic range (SDR) image to a high dynamic range (HDR) image using the color control metadata;

outputting the HDR image from the image processing apparatus to a display device, wherein the image processing device is externally connected to the display device, and wherein the display device is a physically separate device from the display device; and displaying the HDR image on the display.

7. A non-transitory computer readable medium having stored thereon a computer program for an image processing apparatus, the program comprising:

acquiring color control metadata from a plurality of color control metadata using the image processing apparatus for a detected display device, wherein the color control metadata is specific to the detected display device;

converting a standard dynamic range (SDR) image to a high dynamic range (HDR) image using the color control metadata;

outputting the HDR image from the image processing apparatus to a display device, wherein the image processing device is externally connected to the display device, and wherein the display device is a physically separate device from the display device; and displaying the HDR image on the display.

* * * * *